US005239790A

United States Patent [19]

Fetzer

[11] Patent Number: 5,239,790

[45] Date of Patent: Aug. 31, 1993

[54] ATTIC SHELF

[76] Inventor: Paul T. Fetzer, Box 121-A L.O.W., Locust Grove, Va. 22508

[21] Appl. No.: 886,907

[22] Filed: May 22, 1992

[51] Int. Cl.[5] ..... A47B 5/00

[52] U.S. Cl. ..... 52/36.4; 52/90.1; 312/245

[58] Field of Search ..... 52/36, 202, 203, 19, 52/90, 91, 92, 404, 39; 182/46, 47, 81, 78, 79, 80; 49/463; 312/245, 246; 108/47, 48

[56] References Cited

U.S. PATENT DOCUMENTS

| | | | |
|---|---|---|---|
| 241,827 | 5/1881 | Sherman . | |
| 617,164 | 1/1899 | Jewett . | |
| 2,292,797 | 8/1942 | Roberts . | |
| 3,574,434 | 4/1971 | Propst | 312/345 |
| 3,698,329 | 10/1972 | Diamond et al. . | |
| 3,722,171 | 3/1973 | Godley | 52/90.1 |
| 3,727,544 | 4/1973 | Devillard . | |
| 3,972,164 | 8/1976 | Grange | 52/95 |
| 4,245,449 | 1/1981 | Jackson | 50/639 |
| 4,299,059 | 11/1981 | Smith | 182/47 X |
| 4,446,660 | 5/1984 | Miller et al. | 52/39 X |
| 4,944,126 | 7/1990 | King | 52/202 |

FOREIGN PATENT DOCUMENTS

| | | | |
|---|---|---|---|
| 2211076 | 6/1989 | United Kingdom | 312/245 |

*Primary Examiner*—Carl D. Friedman
*Assistant Examiner*—Kien T. Nguyen
*Attorney, Agent, or Firm*—Lowe, Price, LeBlanc & Becker

[57] ABSTRACT

A preassembled attic shelf unit includes a pair of shelf support members connected to each other with wooden connectors so that outward facing surfaces of the support units are engageable with portions of adjacent roof trusses located on fixed centers. Each shelf support member may be rectangular wooden stock material formed with an elongate rectangular groove in an inward facing surface thereof so that the opposing grooves respectively receive longitudinal edges of the shelf in sliding supporting engagement. Nails may be utilized to fasten the shelf supporting members directly to the portions of the trusses such as web member portions interconnecting top and bottom chord members of the trusses together.

19 Claims, 3 Drawing Sheets

ATTIC SHELF

TECHNICAL FIELD

The present invention relates generally to shelving and, more particularly, to fixed width shelf support structures mounted to on-center spaced, building construction materials, such as roof trusses.

BACKGROUND ART

FIG. 1 is an illustration of one type of roof truss 10 typically employed in the construction of roofs for single or multi-family homes. The truss 10 includes a plurality of bottom chords such as 12 and 14 which are joined end-to-end as at 16 with conventional nail connector plates 18 (e.g., 20 gauge ILS plates). These bottom chords 12,14 are often made of kiln dried (KD) Southern pine and may have rectangular cross-sectional nominal dimensions of two inches by four inches (2×4's). The bottom chords 12,14 extend continuously to define a floor joist 20 secured, in a conventional manner, to beams 22 distributed at prescribed intervals as required by governmental (e.g., county) code.

The upper extent of the truss 10 is defined by oppositely inclined rafters 24 and 26 joined at their upper ends with a nail connector plate 28 to define an apex 30 of the roof truss 10. The lower ends of the rafters 24 and 26 are respectively connected to opposite ends of the joist 20 with nail connector plates 32 to define left and right heels 34 and 36, respectively. Each rafter 24 and 26 is formed from top chord members 38 connected together with nail plates 39. These top chords 38 are often made of kiln dried (KD) Southern pine and may have rectangular cross-sectional nominal dimensions of two by six inches. Depending upon the loading requirements, either two by four or two by six lumber may be used, or other suitable dimensions, for the top and bottom chords 12, 14 and 38.

In the roof truss 10 of FIG. 1, four web members 40 and 42 interconnect the top chords 38 to the bottom chords 12,14 as is well known. A first pair of webs 42 may each be secured to apex 30 at their upper ends with the nail connector plate 28 and extend downwardly for connection to the floor joist 20 with nail connector plates 43. The second pair of chords 40 are respectively connected at their lower ends to the lower ends of the chords 42 and to the floor joists with the nail connector plates 43 and project upwardly for respective connection at their upper ends to the rafters 24 and 26 with nail plates 45 and at right angles thereto for smooth load transmission from top to bottom. These webs 40,42 may also be manufactured from two by four, two by six or other suitably dimensioned lumber kiln dried Southern pine.

A plurality of substantially identical roof trusses 10 (see, e.g., FIG. 2) are then mounted to the beam 222 at regularly spaced intervals. Continuous lateral support between the roof trusses 10 is provided in a known manner by means of plywood sheathing 48 secured to the upper surfaces of the top chord members 38. Properly spaced purlins (not shown) may be optionally provided between adjacent top chords 38 of adjacent trusses 10 to improve lateral bracing as appropriate. Roof paper and shingling (also not shown) is applied to the upper exposed surface of the plywood sheathing 48 to complete the roof. Insulation material 50 is typically disposed between the joists 20 of adjacent roof trusses 10 and drywall (not shown) is secured to the lower surfaces of the bottom chords 12,14 to define the ceiling in the upper level of the home.

The resulting attic space 52 defined between the joists 20 and the rafters 24,26 is typically accessed through an attic door 54 with a foldable stairway (not shown) mounted within the joist system 20 in a known manner. The homeowner and sometimes the builder will loosely place or secure sheets of plywood 56 or other lumber material on the top surfaces of the bottom chords 12,14 so that the attic space 52 may be used for storage. This tends to be an inefficient usage of the attic storage space 52 since the only conventionally available "shelf" storage surface is the attic floor defined by and between the joists 20. Often, items to be stored are strewn about the attic floor in a haphazard manner or more typically piled on top of each other immediately adjacent the attic door 54, making finding or relocating of stored objects very difficult if not impossible.

It is accordingly one object of the present invention to more effectively utilize unfinished space within constructed buildings for storage purposes.

Another object is to increase the storage space within unfinished floor space of residential homes by allowing for easy installation of vertically spaced shelving mountable to portions of adjacent roof trusses.

Still a further object is to provide for vertically spaced fixed width shelving support units thereby being easily positionable between and mountable to opposing surfaces of portions of adjacent roof trusses which portions are provided at predetermined on-center (O.C.) spacing intervals.

DISCLOSURE OF THE INVENTION

An attic having a shelf and a supporting system therefor, in accordance with the present invention, comprises a plurality of roof trusses generally equispaced from each other on predetermined centers and along supporting beams. Each truss includes top chord members connected together to define roof rafters and bottom chord members connected together to define attic floor joists. The floor joists are connected to the rafters to define a predetermined truss configuration. At least one web member interconnects the top and bottom chords together. There is further provided a shelf and a mounting means, secured to the web members, for mounting the shelf to the web members of adjacent trusses at a predetermined elevation in relation to the floor joists.

The shelf is preferably slidably supported on the mounting means which may include a pair of shelf support members and means for interconnecting the shelf support members to each other.

In accordance with a preferred feature of this invention, the shelf support members are parallel to each other and respectively include outwardly directed fastening surfaces which are spaced a predetermined distance from each other through the interconnecting means so as to be respectively engageable with an inwardly directed engagement surface of the web members. Each shelf support member may include an elongated mounting bracket having a vertically extending first portion and a horizontally extending second portion attached to the first portion at right angles to each other. The shelf has longitudinal edges resting on upwardly directed surfaces of the second portions which project inwardly from the first portions. The second portions slidably support the shelf in the preferred embodiment.

The interconnecting means may include connecting members secured, at opposite ends thereof, to the second portions below the upwardly directed support surfaces thereof.

In accordance with this invention, a plurality of shelves and associated mounting means may be provided such that the shelves are mounted between different adjacent pairs of the web members. In this manner, a multitude of shelves may be provided in the attic whereby the shelf supports are installed to the web members as preassembled units which is possible in view of the on-center spacing between the trusses.

The present invention also features an attic shelf adapted to be installed to and between adjacent roof trusses in an attic space. The attic shelf comprises a shelf and a pair of shelf support members. Means is provided for connecting the shelf support members together so that they extend generally parallel a predetermined fixed distance from each other corresponding to the on-center (O.C.) spacing between adjacent trusses. The fixed distance spacing enables the shelf support members to be sold as a preassembled unit to be fastened directly to portions of adjacent roof trusses without cutting of the preassembled shelf support members or the shelf to desired widths by the end user (homeowner).

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST NODE FOR CARRYING OUT THE INVENTION

Figure 1:
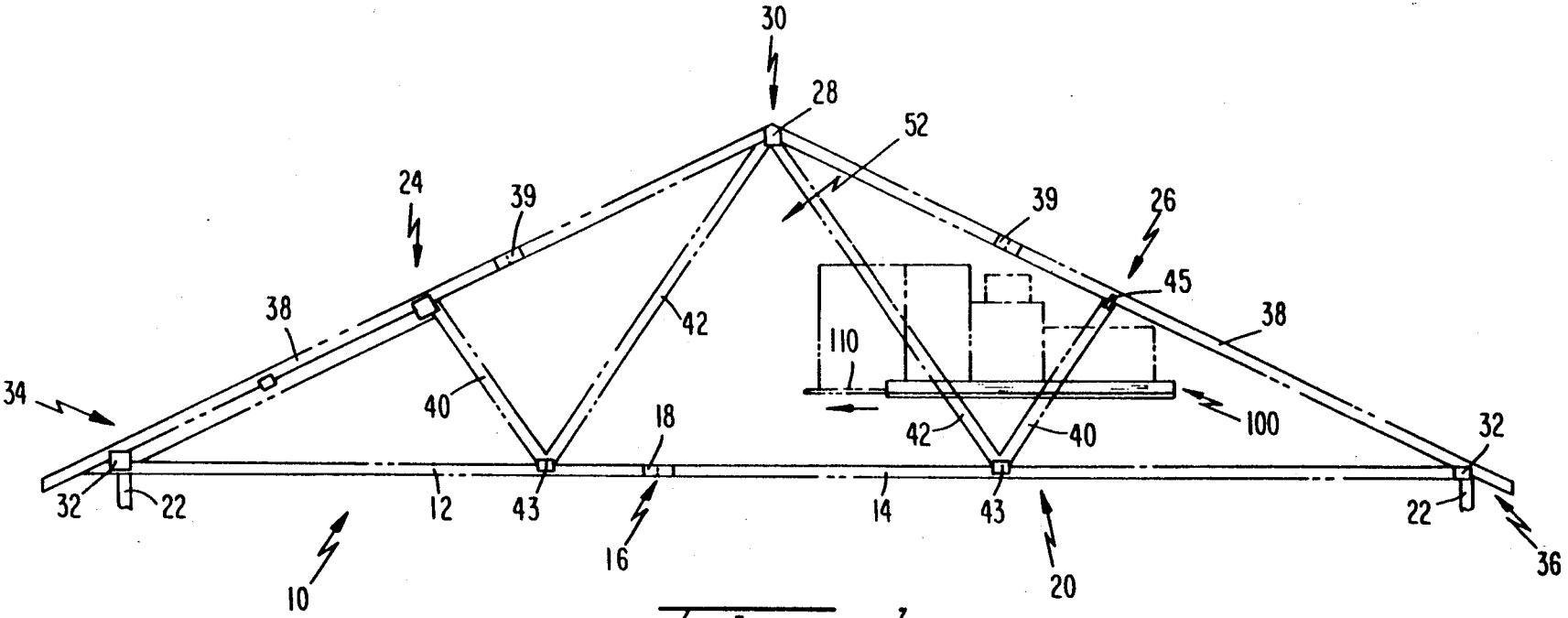
FIG. 1 is an elevational view of a conventional roof truss (but including a shelf according to the invention) used in the manufacture of single or multifamily residential homes.
Figure 2:
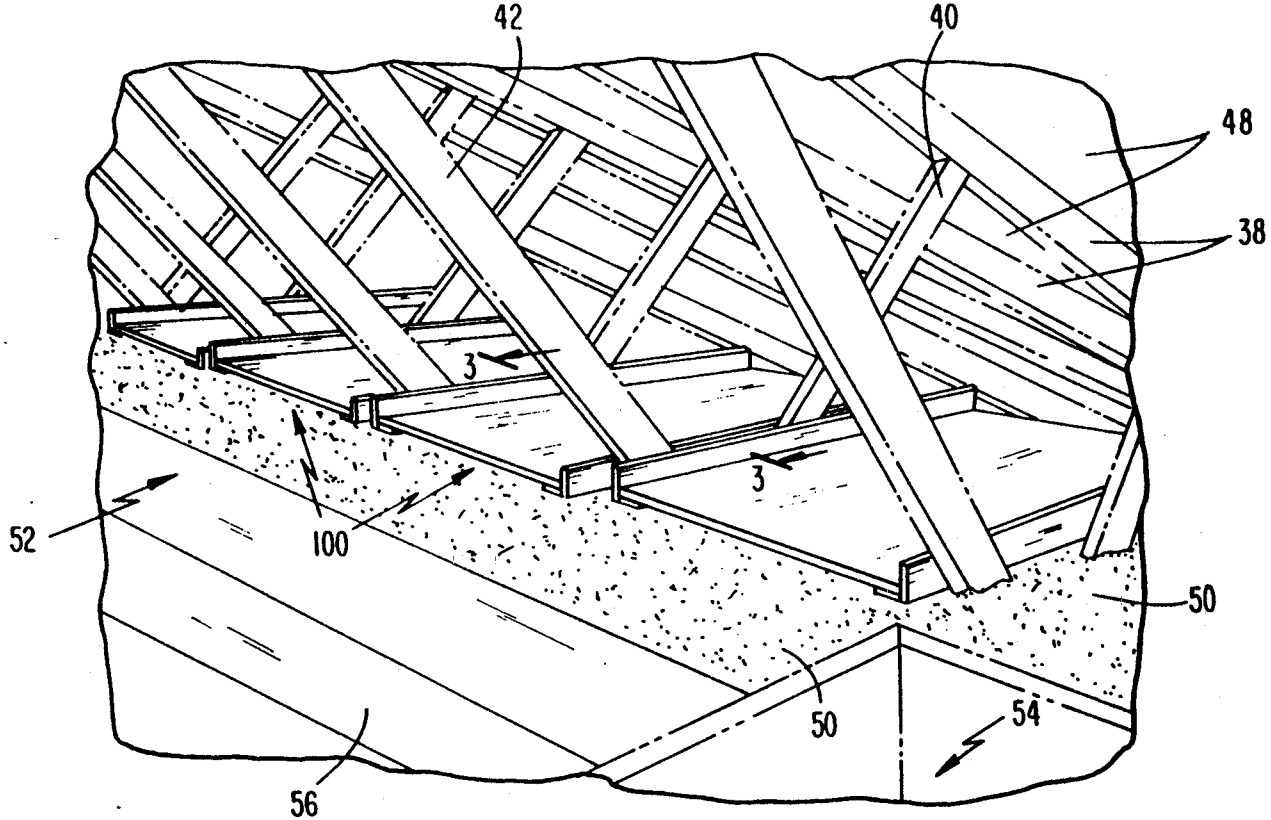
FIG. 2 is a perspective view of an attic and a shelving system therein in accordance with a first embodiment of the present invention.

FIG. 2 is an illustration of a first preferred embodiment of the present invention wherein a plurality of preassembled attic shelf units 100 in accordance with the invention are mounted side-by-side to successively adjacent pairs of roof truss web members 40 and 42.

Figure 3:
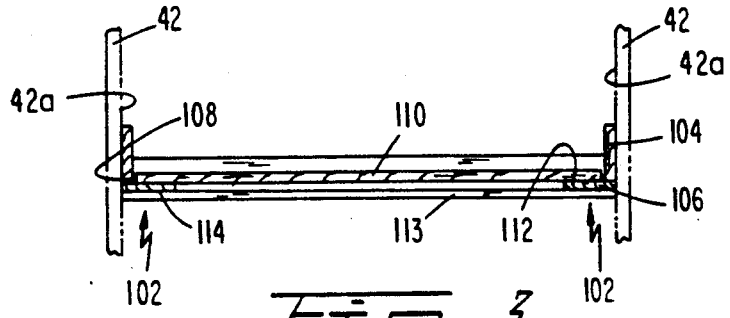
FIG. 3 is a sectional view taken along the line 3—3 of FIG. 2.

In this embodiment, each shelf 100 comprises a pair of identical shelf support brackets 102 of L-shaped configuration in cross-section (FIG. 3). Each bracket 102 includes an elongate vertically extending fastening member 104 adapted to be nailed or otherwise secured to the web members 40,42 of the associated truss, and a second shelf supporting member 106 secured to the lower edge of the fastening member 104 to project inwardly therefrom at right angles. The longitudinal edges 108 of the shelf member 110 are respectively slidably supported on the upper surface 112 of the supporting members 106.

In this embodiment, the shelf 100 may be sold as a preassembled unit wherein the pair of shelf brackets 102 are not attached to each other but are supplied with the shelf member 110 cut to predetermined width and length such that the shelf member width plus the thickness of the fastening members 104 generally correspond to, or are slightly less than, the distance between the inward facing surfaces **42*a* of the webs 40,42 provided at on-center spacing intervals. Thus, assembly of this first embodiment is easy, requiring the installer to simply nail the first L-shaped bracket 102 to the one or more webs 40,42 of an associated truss 10 and then nail the second shelf bracket 102 to the one or more webs of the adjacent truss. The truss orientation and predetermined on-center spacing thus automatically provides an effective means for mounting the first and second shelf brackets 102 parallel to each other. The shelf member 110 is then positioned on the sliding surfaces 112 of the inwardly extending shelf support pieces 106**.

The L-shaped brackets 102 may be manufactured from, for example, plywood of three-eighths inch to one inch thickness which may be joined together with known fastening means, such as glue, nails, screws and/or L-shaped metal brackets.

The L-shaped brackets 102 may also be preassembled together with a pair of front and rear transversely extending wooden members 113 formed of rectangular stock. Depending upon the application, the opposite ends of these connecting members 113 may overlap and be secured to the lower surfaces 114 of the horizontally extending portions 106 of the L-shaped brackets 102 such as with glue, nails, screws, etc. If it is desirable that these connecting members 113 not extend below the L-shaped brackets 102, they may be of predetermined length (not shown) so that opposite ends thereof abut against the inward facing edges of the shelf supporting portions 106 of the brackets. The length of these connecting members 113 is predetermined so as to achieve the desired on-center spacing between the brackets 102 (FIG. 3).

Figure 4:
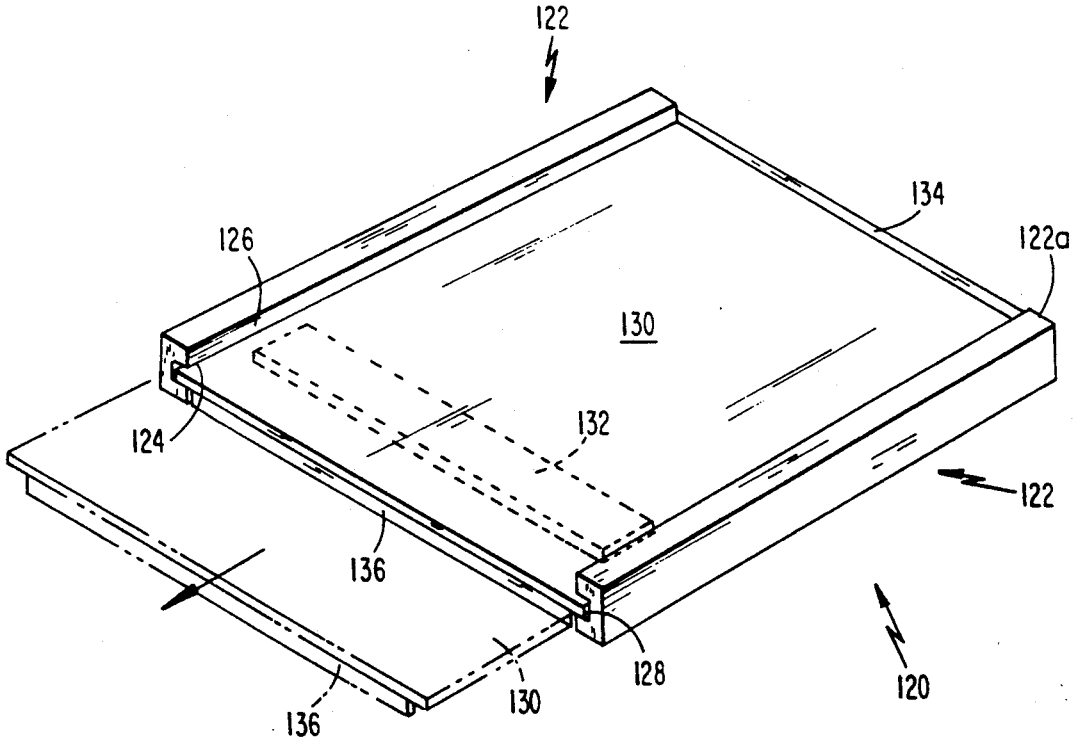
FIG. 4 is a perspective view of a second embodiment of a shelving unit in accordance with the present invention.

FIG. 4 is an illustration of a second preferred embodiment 120 of this invention wherein each shelf support bracket 122 is an elongate wooden member of rectangular stock with a rectangular groove 124 formed in the inwardly facing wide surface 126 thereof. Each groove 124 is adapted to receive a corresponding longitudinal edge 128 of the shelf 130 in smooth sliding engagement. The shelving brackets 122 are maintained parallel to each other at a fixed distance corresponding to the on-center spacing between the roof trusses 10 through a pair of front and rear transversely extending wooden connecting members 132 and 134. The rear connecting member 134 may be fixed to the rear surfaces **122*a* of the shelf brackets 122 without extending above or below the upper and lower surfaces of the brackets. The front connecting member 132 may extend between the inward facing surfaces 126 of the shelf brackets 122 at front portions thereof and the opposite ends of this front member may flushly engage these inward facing surfaces and be secured thereto with nails or screws (not shown in detail) driven into these opposite ends through the outward facing surfaces of the shelf brackets. Optionally, a shelf handle 136 in the form of a wooden strip may be secured to the lower surface of the shelf 130** flush or along the front surface of the shelf to provide easy gripping and sliding of the shelf relative to its preassembled supporting assembly.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. An attic having a shelf and a supporting system therefor, comprising:

(a) a plurality of roof trusses generally equispaced from each other along supporting beams on predetermined centers, each truss including:

(i) top chord members connected together to define roof rafters, (ii) bottom chord members connected together to define attic floor joists, said floor joists being connected to said rafters to define a predetermined and truss configuration; and (iii) at least one web member interconnecting the top and bottom chords together;

(b) a shelf; and (c) means, secured to said at least one web member, for mounting said shelf to the web member of adjacent trusses at a predetermined elevation in relation to the floor joists.

2. The attic shelf of claim 1, wherein said shelf is slidably supported on the mounting means.

3. The attic shelf of claim 1, wherein said mounting means includes a pair of shelf support members and means for interconnecting said shelf support members to each other.

4. The attic shelf of claim 3, where said shelf support members extend generally parallel to each other and respectively include outwardly directed fastening surfaces which are spaced a predetermined distance from each other through said interconnecting means so as to be respectively engageable with an inwardly directed engagement surface of the web members.

5. The attic of claim 4, wherein each shelf support member includes an elongated mounting bracket having a vertically extending first portion and a horizontally extending second portion attached to the first portion at right angles to each other, said shelf having longitudinal edges resting on upwardly directed surfaces of said second portions which project inwardly from the first portions.

6. The attic shelf of claim 5, wherein said second portions slidably support the shelf.

7. The attic shelf of claim 5, wherein said interconnecting means includes connecting members secured, at opposite ends thereof, to the second portions below the upwardly directed support surfaces thereof.

8. The attic shelf of claim 7, further comprising a plurality of shelves and associated mounting means, whereby said shelves are mounted between different adjacent pairs of said web members.

9. The attic shelf of claim 8, wherein said shelves are mounted successively adjacent each other.

10. The attic shelf of claim 9, wherein each shelf is slidably supported on its associated second portions.

11. The attic shelf of claim 8, wherein each shelf is slidably supported on its associated second portions.

12. The attic shelf of claim 5, wherein said first and second portions are L-shaped in cross section.

13. The attic shelf of claim 4, wherein the outwardly directed parallel fastening surfaces extend vertically and are fixedly spaced from each other to contact the web members located on eighteen inch centers.

14. The attic shelf of claim 4, wherein the outwardly directed parallel fastening surfaces extend vertically and are fixedly spaced from each other to contact the web members located on twenty-four inch centers.

15. The attic shelf of claim 4, wherein said shelf support members respectively include a groove formed in the inwardly facing surface thereof adapted to receive a longitudinal edge of the shelf in sliding engagement therewith, said interconnecting means includes a first wooden connecting member extending between the shelf support members and having opposite ends secured to the inwardly facing surfaces of said shelf support members below the groove, said interconnecting means further including a second wooden member secured to the rear surfaces of said shelf supporting members, said second member defining a stop surface against which the rear edge of the shelf abuts when the shelf is fully slidably inserted into the preassembled shelf supporting unit.

16. The attic shelf of claim 5, further including a handle means secured to the lower surface of the shelf, said handle means extending between the shelf supporting members.

17. A preassembled attic shelf unit adapted to be installed to and between adjacent roof trusses in an attic space, comprising:

(a) a shelf;

(b) a pair of shelf support members; and (c) means for connecting said shelf support members together so that they extend generally parallel a predetermined fixed distance from each other corresponding to the on-center (O.C.) spacing between adjacent trusses, whereby said fixed distance spacing enables said shelf support members to be fastened directly to portions of adjacent roof trusses.

18. The preassembled attic shelf unit of claim 17, wherein each shelf support member includes an elongated mounting bracket having a vertically extending first portion and a horizontally extending second portion attached to the first portion at right angles to each other, said shelf having longitudinal edges resting on upwardly directed surfaces of said second portions which project inwardly from the first portions.

19. The preassembled attic shelf unit of claim 17, further including a handle means secured to the lower surface of the shelf, said handle means extending between the shelf supporting members.

* * * * *